US005308405A

United States Patent [19]

McElroy

[11] Patent Number: 5,308,405

[45] Date of Patent: May 3, 1994

[54] TOILET BOWL CLEANING SYSTEM

[76] Inventor: John F. McElroy, 324 N. Margeno Ave., Alhambra, Calif. 91804

[21] Appl. No.: 943,224

[22] Filed: Sep. 9, 1992

[51] Int. Cl.[5] ..... B08B 1/00; A47K 1/14

[52] U.S. Cl. ..... 134/24; 134/22.1; 4/422; 4/295; 4/286

[58] Field of Search ..... 4/422, 295, 286; 134/22, 24

[56] References Cited

U.S. PATENT DOCUMENTS

| | | | |
|---|---|---|---|
| 1,323,580 | 12/1919 | Dickey . | |
| 1,361,972 | 12/1920 | Drake . | |
| 2,171,710 | 9/1939 | Perry | 4/257 |
| 2,311,196 | 2/1943 | Ahern | 141/1 |
| 2,311,197 | 2/1943 | Ahern | 141/1 |
| 2,327,602 | 8/1943 | Kesteloot | 182/1 |
| 2,430,976 | 11/1947 | Dutra | 15/104.05 |
| 3,172,415 | 7/1962 | Maushund | 4/255.11 |
| 3,480,021 | 11/1969 | Ewald, Jr. | 134/24 |
| 3,839,744 | 10/1974 | Ziegelmeyer et al. | 4/1 |
| 4,137,577 | 2/1979 | Maxfield | 4/231 |

*Primary Examiner*—Henry J. Recla
*Assistant Examiner*—Gregory Vidovich
*Attorney, Agent, or Firm*—Albert O. Cota

[57] ABSTRACT

A method is provided for cleaning a toilet bowl and dissolving mineral deposits in the holes under the rim of the toilet which includes the steps of (a) flushing the toilet to empty the tank and to initiate the flow of refill water into the tank; (b) holding down the flush handle to cause the refill water to continuously flow out of the tank and into the toilet bowl; (c) plugging the drain to cause the water level in the bowl to rise towards the rim; (d) releasing the flush handle when the water in the bowl rises to a height proximate to the top of the bowl to prevent the flow of additional refill water into the bowl; (e) adding to the water in the bowl a cleaning agent to cleanse the bowl, including the area of the bowl under the rim; and (f) unplugging the drain and flushing the toilet to rinse the cleaning agent and water mixture from the bowl. The drain can be plugged with a drain stopper which includes a flexible disc swivably attached to a handle by a hinge. In embodiments where the hinge is attached to the disc slightly removed from the geometric center of the disc, the disc will tend to gravitate into a parallel relationship with the handle so that the disc can be conveniently stored in a storage device which also houses the scrubbing tool.

1 Claim, 2 Drawing Sheets

TOILET BOWL CLEANING SYSTEM

FIELD OF THE INVENTION

This invention relates generally to systems for cleaning a toilet bowl, and, specifically, to systems for cleaning under the upper rim of a toilet bowl.

BACKGROUND OF THE INVENTION

Cleaning a toilet bowl is generally a difficult and unappealing task. Many of the stains and grime which build up in a toilet bowl are difficult to remove, and most people are reluctant to get their hands down into the toilet bowl. The job is complicated by the fact that the lower half of the bowl is under water.

To get around many of these problems, it has become common to clean a toilet bowl by adding some sort of cleaning agent to the toilet bowl water, allowing the cleaning agent and water mixture to stand for a period of time and then scrubbing the toilet bowl with some sort of brush or scrubbing pad.

Unfortunately, this method cannot be applied to that portion of the toilet bowl above the level of the water. Accordingly, it is still necessary to clean this portion of the bowl by hand.

Cleaning under the upper edge of the bowl is especially difficult because stains and grime in this area cannot be seen without a mirror and because the circular configuration of the rim makes scrubbing an awkward activity. If this area is not regularly cleaned, however, germs and bacteria will accumulate. This may become a health hazard and/or a source of undesirable odors. Also, if this area is not cleaned regularly, the flushing holes, essential for the efficient operation of the toilet, may become obstructed by mineral deposits.

There have been a couple of suggestions in the prior art for methods to fill the bowl with water during the cleaning operation to allow for a prolonged soaking of the upper portions of the bowl with a cleaning agent. For example, U.S. Pat. No. 3,480,021 (issued to Ewald, Jr., Jan. 18, 1968) teaches the use of a bulb-like stopper on a handle. The stopper is used to plug the drain of the toilet to allow the water within the bowl to rise. The handle has a small overflow port which purportedly keeps the bowl from overflowing during flushing. Also, in U.S. Pat. No. 3,839,744 (issued to Ziegelmeyer, et al., Oct. 8, 1974) teaches a similar method for causing the water in the toilet bowl to rise. Ziegelmeyer, et al., teach the use of a disc-like stopper on a handle to plug the toilet bowl drain. The handle provides an overflow device for preventing water in the bowl from overflowing during flushing.

Neither of these methods has been found to be fully satisfactory, however. Both methods require careful adjustments of the overflow device to attain the desired water elevation. Both methods also rely on the hollow handle of the tool to carry away excess water to prevent the bowl from overflowing, but in neither case is the handle sized sufficiently large to carry away the tremendous amount of water which would rush into the toilet during a flushing operation. Furthermore, the Ziegelmeyer, et al. method does not provide a method for cleaning under the rim of the toilet.

Accordingly, there is a need for a better method of cleaning a toilet bowl, especially for cleaning under the rim of a toilet bowl. The method should be inexpensive and simple to apply without posing any significant danger of overflowing the toilet bowl.

SUMMARY OF THE INVENTION

The invention satisfies this need.

The invention is a method for cleaning a toilet bowl comprising the steps of: (a) flushing the toilet to empty the tank and to initiate the flow of refill water into the tank; (b) holding down the flush handle to cause the refill water to continuously flow out of the tank and into the toilet bowl; (c) plugging the drain to cause the water level in the bowl to rise towards the rim; (d) releasing the flush handle when the water in the bowl rises to a height proximate to the top of the bowl to prevent the flow of additional refill water into the bowl; (e) adding to the water in the bowl a cleaning agent to cleanse the bowl, including the area of the bowl under the rim; and (f) unplugging the drain and flushing the toilet to rinse the cleaning agent and water mixture from the bowl.

The invention is also a device for plugging the drain comprising a flexible disc which is attached to a handle by a hinge. The hinge is offset so that, when not in use, the disc automatically folds against the handle when the handle is held vertically. This feature makes the device easy to store between cleaning operations.

DESCRIPTION OF THE DRAWINGS

These and other features, aspects, and advantages of the present invention will become better understood with reference to the following description, appended claims, and accompanying drawings where:

DETAILED DESCRIPTION

Figure 1:
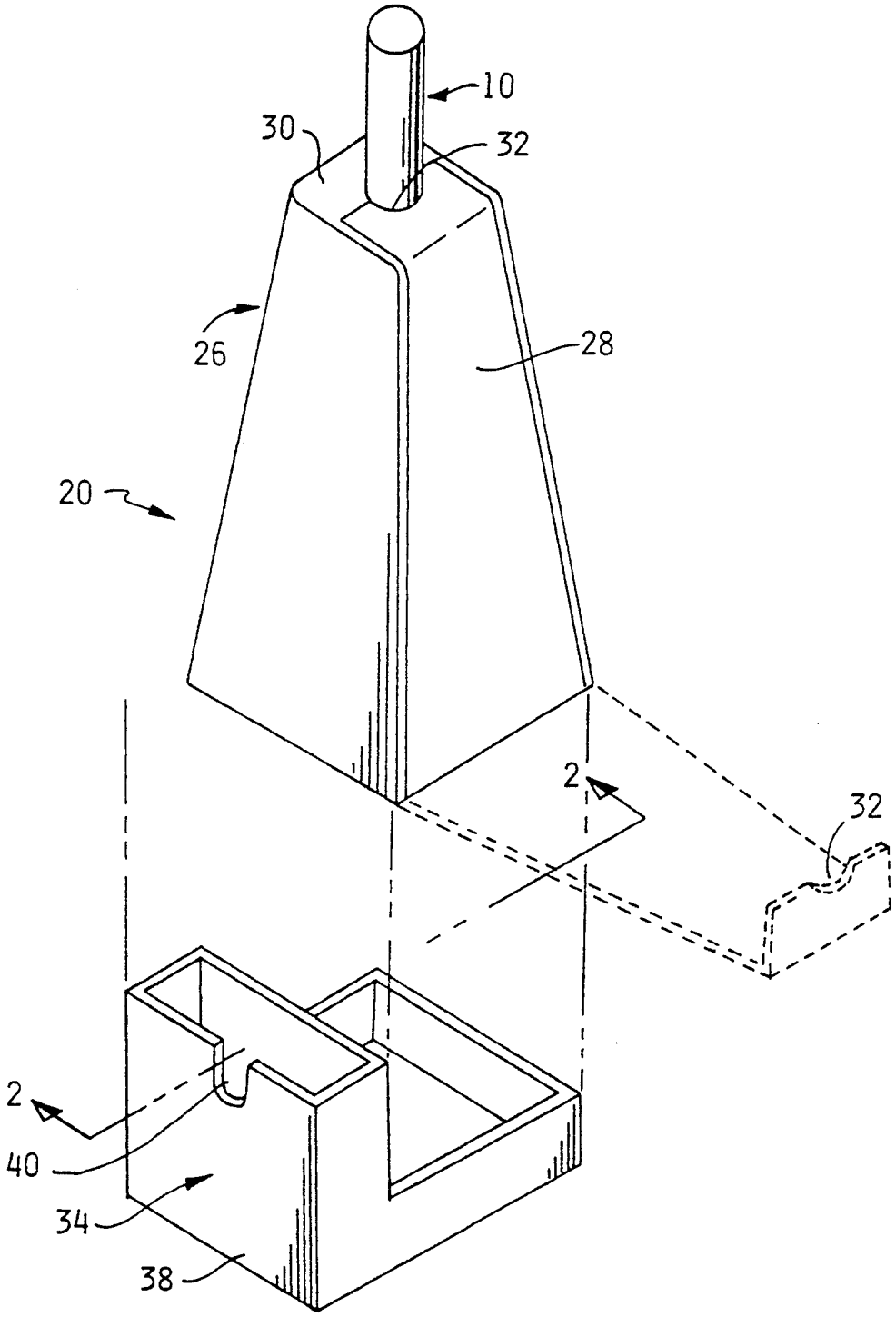
FIG. 1 is a perspective view of a caddy and an open topped compartment combination useful in the invention.

The invention is a method of cleaning a toilet bowl in a standard toilet having a toilet tank, a flush handle and a toilet bowl. The toilet bowl has a top, a bottom, a drain proximate to the bottom and a rim which extends around the periphery of the top.

The method comprises the steps of: (a) flushing the toilet to empty the tank and to initiate the flow of refill water into the tank; (b) holding down the flush handle to cause the refill water to continuously flow out of the tank and into the toilet bowl; (c) plugging the drain to cause the water level in the bowl to rise at a moderate rate towards the rim; (d) releasing the flush handle when the water in the bowl rises to a height proximate to the top of the bowl to prevent the flow of additional refill water into the bowl; (e) adding to the water in the bowl a cleaning agent to cleanse the bowl, including the area of the bowl under the rim; and (f) unplugging the drain and flushing the toilet to rinse the cleaning agent and water mixture from the bowl.

The cleaning agent can be any of the many cleaning agents presently on the market, including soaps, detergents, bleaches, ammoniated compounds and other basic compounds. The method works best if, after adding the cleaning agent to the water in the bowl, the water and cleaning agent mixture is allowed to remain in the bowl for at least about one minute, preferably at least about two minutes, and most preferably at least about five minutes.

Preferably, the method comprises the further step of, after adding the cleaning agent to the bowl water, most preferably, after allowing the cleaning agent water mixture to soak for a few minutes, the bowl is lightly scrubbed with a scrubbing tool 10.

The cleaning tool 10 can be any of the standard cleaning tools known in the art. Scrub brushes can be used, as can scouring pads and cloths. A scouring pad made of plastic disposed at the end of a handle can also be used.

The drain can be plugged in a variety of ways. Preferably the plugging is accomplished with a stopper tool 12 having a plug 14 and a handle 16 attached to the plug 14. The plug 14 is dimensioned to seal the toilet bowl drain. The plug 14 can be of any shape which accomplishes this task. Preferably, the plug 14 is a disc dimensioned to fit over the drain to cover the drain. Most preferably, the disc is made of a flexible material which will tend to conform to the curved surface surrounding the drain.

The handle 16 and the plug 14 can be made out of any material which does not corrode or otherwise deteriorate during the cleaning process. Preferably the plug 14 is made from a flexible plastic or rubber material.

Preferably, the handle 16 is dimensioned to be long enough so that, when the plug 14 is in place sealing the toilet bowl drain, the handle 16 can be rested on the top of the bowl, above the toilet water. This precludes the necessity of the user having to extend his or her hand into the cleaning agent and water combination. For most standard toilet bowls, it is preferable that the handle 16 be at least about 12 inches in length.

Where the plug 14 is a disc, it is preferable that the handle 16 be swivably attached to the disc with a hinge 18 disposed approximate to the geometric center of the disc. Stopper tools 12 having this configuration are easy to manipulate below the surface of the toilet bowl water to adjust the disc into a sealing relationship with the toilet drain while keeping the user's hands well above the surface of the water. In stopper tools 12 having this configuration, the hinged end of the handle has a stabilizer flange 19 to prevent the disc from rotating more than 90° about the hinge 18.

Figure 2:
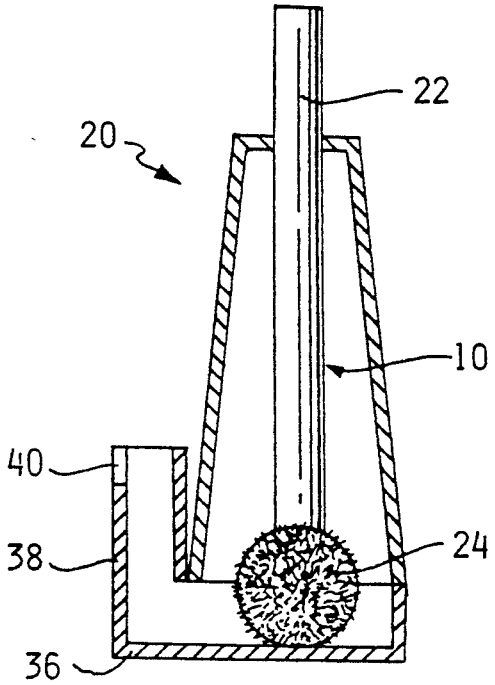
FIG. 2 is a side, cut-away view of the caddy and open topped compartment combination of FIG. 1 taken above line 2—2.
Figure 3:
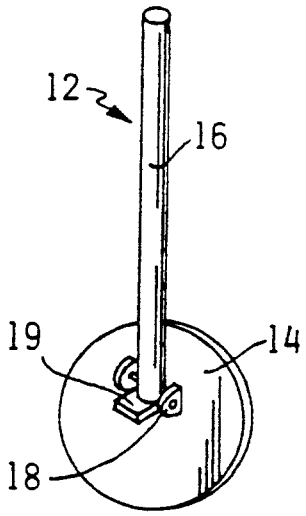
FIG. 3 is a perspective view of a drain stopper device having features of the invention.
Figure 4:
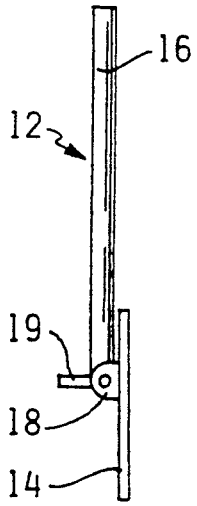
FIG. 4 is a side view of the drain stopper device of FIG. 3.
Figure 5:
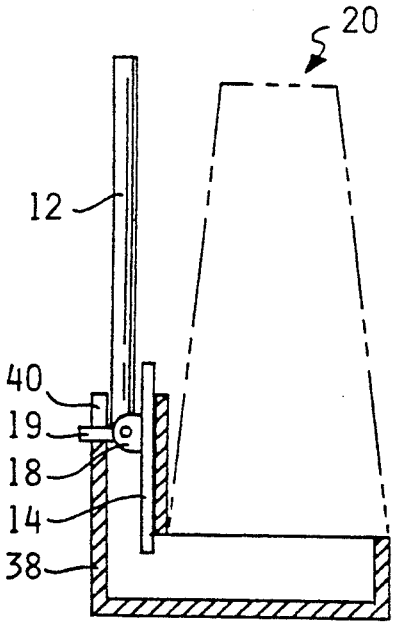
FIG. 5 is a side view in partial cut-away of the drain stopper of FIG. 3 as it could be disposed within the caddy and open topped container combination of FIG. 1.

Most preferably the hinge 18 on the stopper tool 12 is disposed not precisely at the geometric center of the disc, so that, when the handle 16 is vertically deposed above the disc, the disc is caused to gravitate into a substantially parallel relationship with the handle 16. This embodiment is one which is easily stored in a vertical storage department as described below.

Where the stopper tool 12 is a disc swivably attached to a handle 16 as shown in FIG. 3 of the drawings, the stopper tool 12 can be conveniently stored proximate to the cleaning tool 10 in a combination device 20 shown in FIGS. 1, 2 and 5. This combination device 20 comprises (a) the toilet bowl scrub tool 10 having a handle 22 and a scrubbing device 24, such as a brush, a scrub pad or a cloth; (b) the toilet bowl drain stopper tool 12 having the handle 16 swivably attached to a disc; and (c) storage means for retaining the scrub tool 10 and the drain stopper tool 12 in convenient proximate relationship.

As shown in the drawings, the storage means can comprise caddy means for storing the scrub tool 10. As shown in the drawings, such caddy means can be a box 26 with a hinged door 28 which folds downwardly from its top 30. The hinged door 28 has a notch 32 which allows the handle 22 of the scrub tool 10 to protrude through the top 30 of the box 26.

The storage means can also comprise an open-topped compartment 34 disposed proximate to the caddy means. As shown in FIGS. 1, 2 and 5, the open-topped compartment 34 has a base 36 and vertical walls 38. The compartment 34 is dimensioned to accept and retain the disc of the stopper tool 12. One of the vertical walls 38 has a notch 40 which is dimensioned to accept and retain the stabilizer flange 19 on the stopper tool 12. This allows the disc portion of the stopper tool 12 to be stored within the open-topped compartment 34 in a vertical position, in parallel with the vertical walls 38 of the compartment 34. The notch 40 is disposed at sufficient height above the base 36 so that the disc portion of the stopper tool 12 is suspended above the base 36.

The inventor has found that this method of the invention provides the first practical method for cleaning underneath the rim of a toilet bowl. The method allows for the toilet bowl water to rise up to be in contact with the underside of the rim without significant danger of overflowing the bowl. By holding the toilet bowl water in this elevated position, a cleaning agent added to the water can be used to soak away grime, minerals and stains on the underside of the toilet bowl rim to an extent much more thoroughly than most prior art methods. Unlike other prior art methods also, the method of the invention safely allows the water in the bowl to rise to the edge of the rim without danger of overflow caused by having to rely on overflow tubes which must be suspended at exactly the precise height and must also be of sufficient dimension to not allow the toilet bowl to overflow despite the rather large influx of refill water during the flushing operation.

The foregoing describes in detail several preferred embodiments of the invention. The foregoing should not be construed, however, as limiting the invention to the particular embodiments describes. Practitioners skilled in the art will recognize numerous other embodiments as well. For a definition of the complete scope of the invention, the reader is directed to the appended claims.

What is claimed is:

1. In a method of cleaning a toilet having a toilet tank, a flush handle and a toilet bowl, the toilet bowl having a top, a bottom, a rim proximate to the top and a drain proximate to the bottom, said method of cleaning comprising the steps of:

a) flushing the toilet to empty the tank and to initiate the flow of refill water into the tank, b) holding down the flush handle to cause the refill water to continuously flow out of the tank and into the toilet bowl;

c) plugging the drain with a tool comprising a plug and a handle attached to the plug, where the plug is a flexible disc which is attached to the handle by a hinge that is not attached to the disc precisely at the geometric center of the disc so that disposing the handle vertically above the disc causes the disc to gravitate into a substantially parallel relationship with the handle, d) releasing the flush handle when the water in the bowl rises to a height proximate to the top of the bowl to prevent the flow of additional refill water into the bowl;

e) adding to the water in the bowl a cleaning agent to cleanse the bowl, including the area of the bowl under the rim, and f) unplugging the drain and flushing the toilet to rinse the cleaning agent and water mixture from the bowl.

* * * * *